US008487818B2

(12) United States Patent
Kim et al.

(10) Patent No.: US 8,487,818 B2
(45) Date of Patent: Jul. 16, 2013

(54) INTERNAL ANTENNA AND PORTABLE COMMUNICATION TERMINAL USING THE SAME

(75) Inventors: Joon-Il Kim, Seoul (KR); Se-Ho Park, Suwon-si (KR); Woo-Ram Lee, Gimpo-si (KR); Young-Min Lee, Yongin-si (KR); Ki-Hyun Kim, Suwon-si (KR); Seok-Myong Kang, Yongin-si (KR)

(73) Assignee: Samsung Electronics Co., Ltd (KR)

( * ) Notice: Subject to any disclaimer, the term of this patent is extended or adjusted under 35 U.S.C. 154(b) by 593 days.

(21) Appl. No.: 12/757,360

(22) Filed: Apr. 9, 2010

(65) Prior Publication Data

US 2010/0259453 A1 Oct. 14, 2010

(30) Foreign Application Priority Data

Apr. 9, 2009 (KR) ..... 10-2009-0030826
Jun. 1, 2009 (KR) ..... 10-2009-0048220

(51) Int. Cl.
*H01Q 1/38* (2006.01)

(52) U.S. Cl.
USPC ..... 343/702; 343/700 MS

(58) Field of Classification Search
USPC ..... 343/700 MS, 702, 829, 846
See application file for complete search history.

(56) References Cited

U.S. PATENT DOCUMENTS

| | | | | |
|---|---|---|---|---|
| 5,870,057 | A | 2/1999 | Evans et al. | |
| 6,154,179 | A * | 11/2000 | Kohno | 343/719 |
| 6,380,905 | B1 * | 4/2002 | Annamaa et al. | 343/767 |
| 6,384,785 | B1 | 5/2002 | Kamogawa et al. | |
| 7,277,055 | B2 | 10/2007 | Tamaoka | |
| 7,307,587 | B2 * | 12/2007 | Eom et al. | 343/700 MS |
| 7,812,769 | B2 * | 10/2010 | Mizuno et al. | 343/700 MS |
| 7,936,306 | B2 * | 5/2011 | Mierke et al. | 343/700 MS |
| 2005/0054317 | A1 | 3/2005 | Ro et al. | |

FOREIGN PATENT DOCUMENTS

| | | |
|---|---|---|
| CN | 101000975 | 7/2007 |
| KR | 100790593 | 1/2008 |
| KR | 100800100 | 1/2008 |
| KR | 1020080081704 | 9/2008 |
| WO | WO 2009/078677 | 6/2009 |

* cited by examiner

*Primary Examiner* — Tho G Phan
(74) *Attorney, Agent, or Firm* — The Farrell Law Firm, P.C.

(57) ABSTRACT

An internal antenna is provided that includes a first antenna having a first antenna pattern formed on a first dielectric layer, and a second antenna having a second antenna pattern formed on a second dielectric layer. The second dielectric layer has a higher dielectric constant than the first dielectric layer. The first and second antenna patterns are electrically connected to each other.

12 Claims, 9 Drawing Sheets

INTERNAL ANTENNA AND PORTABLE COMMUNICATION TERMINAL USING THE SAME

PRIORITY

This application claims priority under 35 U.S.C. §119(a) to Korean Patent Applications filed in the Korean Intellectual Property Office on Apr. 9, 2009 and Jun. 1, 2009, which were assigned Ser. Nos. 10-2009-0030826 and 10-2009-0048220, respectfully, the disclosures of which are incorporated herein by reference.

BACKGROUND OF THE INVENTION

1. Field of the Invention

The present invention relates generally to an antenna, and more particularly, to a small-size antenna that can be mounted in a portable communication terminal.

2. Description of the Related Art

With the advancement of recent semiconductor technologies and various communication technologies, small-size portable communication terminals have been developed. For example, devices having a wireless communication function include notebooks, Portable Multimedia Players (PMPs), cellular phones, navigation systems, etc.

Wireless communication services offered by the above-mentioned devices include broadcasting services (satellite and/or terrestrial Digital Multimedia Broadcasting (DMB)), communication services, Internet services, and the like. In particular, the broadcasting service, which can be used while a user moves, may be provided by a device having internal and external antennas.

The above-mentioned devices are portable and require antennas having a small size and a capability of high performance to utilize the various services described above. As a result, the devices have used internal antennas as a means for satisfying the size and design factors.

FIG. 1 is a diagram illustrating a conventional internal antenna. An internal antenna 100 includes a dielectric layer 110, and a radiant surface 130 formed on the dielectric layer 110.

The radiant surface 130 is excited by a power supply line provided in a horizontal direction of the dielectric layer 110. A coaxial cable (not shown) may be used as a connection cable. An internal conductor of the coaxial cable is electrically connected to the radiant surface 130.

The internal antenna 100 is applicable to portable communication terminals and therefore the dielectric layer 110 has a low dielectric constant due to size restrictions.

However, the dielectric layer 110 with the lower dielectric constant may induce varying radiant characteristics of an antenna, such as hand phantom or hand effect, in which a reception frequency band is shifted while a user's body contacts the terminal.

FIG. 2 illustrates an experimental result of a frequency band shift due to hand phantom of a conventional internal antenna. A dashed line illustrated in FIG. 2 denotes a graph showing a band of frequencies $f_1'$ and $f_2'$ that the internal antenna desires to receive. A solid line illustrated in FIG. 2 denotes a graph showing a band of frequencies $f_1$ and $f_2$ received by the internal antenna due to hand phantom or hand effect.

In order to minimize a variation in radiant characteristics of an internal antenna due to hand phantom, a part that frequently contacts a user may be separated as far as possible from a part that mounts the internal antenna, an external antenna may be used, and a wideband antenna may be used.

However, there are problems in applying these methods for suppressing hand phantom to portable communication terminals of a limited size.

Although the use of a dielectric layer having a high dielectric constant has been proposed, this also leads to problems such as an increase of loss, a decrease of a bandwidth, and creation of a parasitic parameter. Specifically, when a dielectric layer having a high dielectric constant considering a physical length of an antenna is used, a bandwidth of the antenna is decreased and a propagation loss of the antenna is increased.

SUMMARY OF THE INVENTION

The present invention has been made to address at least the above problems and/or disadvantages and to provide at least the advantages described below. Accordingly, an aspect of the present invention provides an internal antenna that can be mounted in a limited space and can minimize a variation in radiant characteristics of the antenna, such as a frequency shift caused by physical contact with a user.

According to one aspect of the present invention, an internal antenna includes a first antenna having a first antenna pattern formed on a first dielectric layer, and a second antenna having a second antenna pattern formed on a second dielectric layer. The second dielectric layer has a higher dielectric constant than the first dielectric layer, and the first and second antenna patterns are electrically connected to each other.

According to another aspect of the present invention, an internal antenna is provided that includes a first antenna and a second antenna formed on respective dielectric layers and having different dielectric constants. A feed point of the first antenna extends to contact an antenna pattern of the second antenna.

According to an additional aspect of the present invention, a portable communication terminal is provided having a case and an internal antenna. The internal antenna includes a first antenna having a first antenna pattern formed on a first dielectric layer, and a second antenna having a second antenna pattern formed on a second dielectric layer. The second dielectric layer has a higher dielectric constant than the first dielectric layer, the first and second antenna patterns are electrically connected to each other, and the internal antenna is mounted in the case.

According to a further aspect of the present invention, a portable communication terminal is provided having a case, and an internal antenna comprising a first antenna having a first antenna pattern formed on or in the case and a second antenna having a second antenna pattern formed on a dielectric layer. The dielectric layer has a higher dielectric constant than the case. The first and second antenna patterns are electrically connected to each other.

BRIEF DESCRIPTION OF THE DRAWINGS

The above and other aspects, features and advantages of the present invention will be more apparent from the following detailed description when taken in conjunction with the accompanying drawings, in which.

DETAILED DESCRIPTION OF EMBODIMENTS OF THE PRESENT INVENTION

Figure 1:
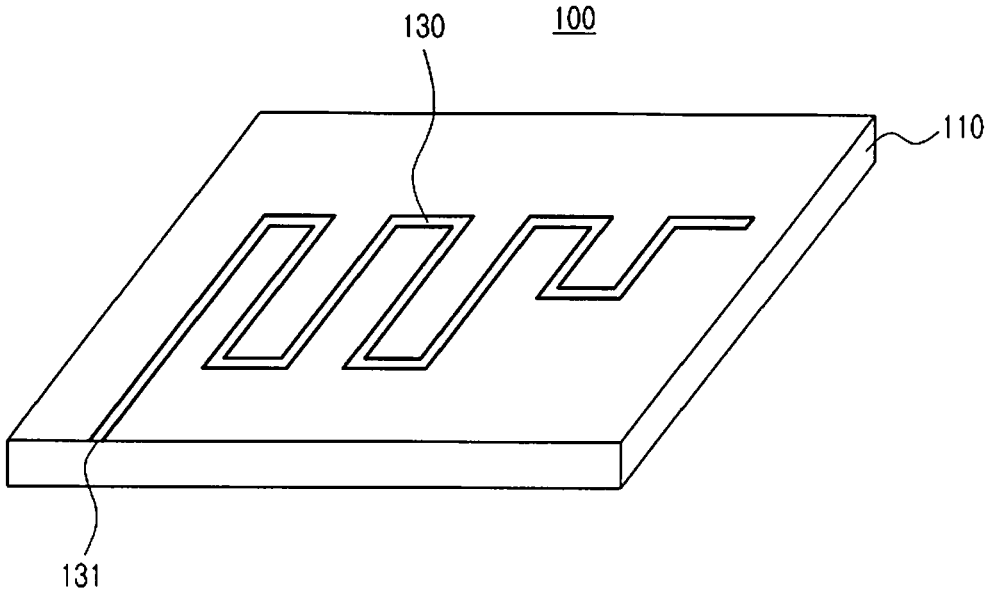
FIG.1 (PRIOR ART)
FIG. 1 is a diagram illustrating a conventional internal antenna.
Figure 2:
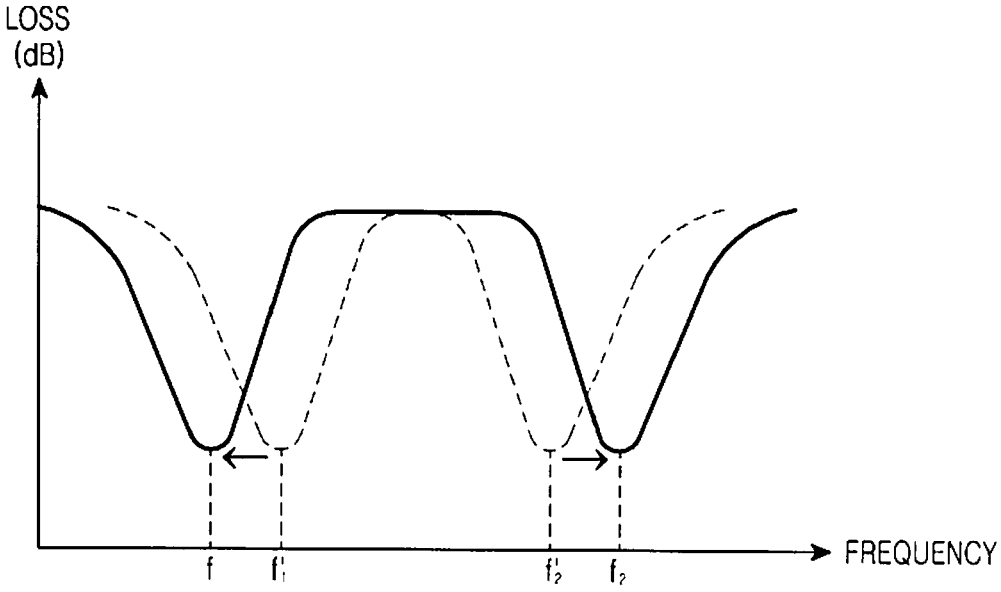
FIG.2 (PRIOR ART)
FIG. 2 is graphs showing a frequency band shift due to hand phantom of a conventional internal antenna.

Embodiments of the present invention are described in detail with reference to the accompanying drawings. The same or similar components may be designated by the same or similar reference numerals although they are illustrated in different drawings. Detailed descriptions of constructions or processes known in the art may be omitted to avoid obscuring the subject matter of the present invention.

Embodiments of the present invention provide an internal antenna in which antennas having electrically conductive antenna patterns formed on dielectric layers having different dielectric constants are coupled to be resonant. A central frequency of an antenna having a higher dielectric constant (or a higher Q value) of two antennas is located at an edge of a desired reception frequency band. The Q value refers to an effect of a resonant system's resistance to oscillation. A high Q value implies low resistance. A Q value or Q factor may be defined as $f_0/\Delta f$, where $f_0$ is a central frequency and $\Delta f$ is a bandwidth (i.e., a width of a range of frequencies) for which a stored energy in an antenna (or a resonator of the antenna) is at least half its peak value, or a reception or radiation gain (or strength) of the antenna is at least 3 dB (70.7%) of its peak value. Conventionally, $\Delta f$ is referred to a −3 dB bandwidth or half-power bandwidth.

Specifically, two antennas having different Q values are coupled to be resonant. A central frequency of an antenna having a higher Q value and which is not influenced by physical contact with a user is located at an edge of a receivable frequency band of an internal antenna. Accordingly, the internal antenna can minimize hand phantom or hand effect, such as a shift of a frequency band caused by physical contact with a user.

Figure 3A:
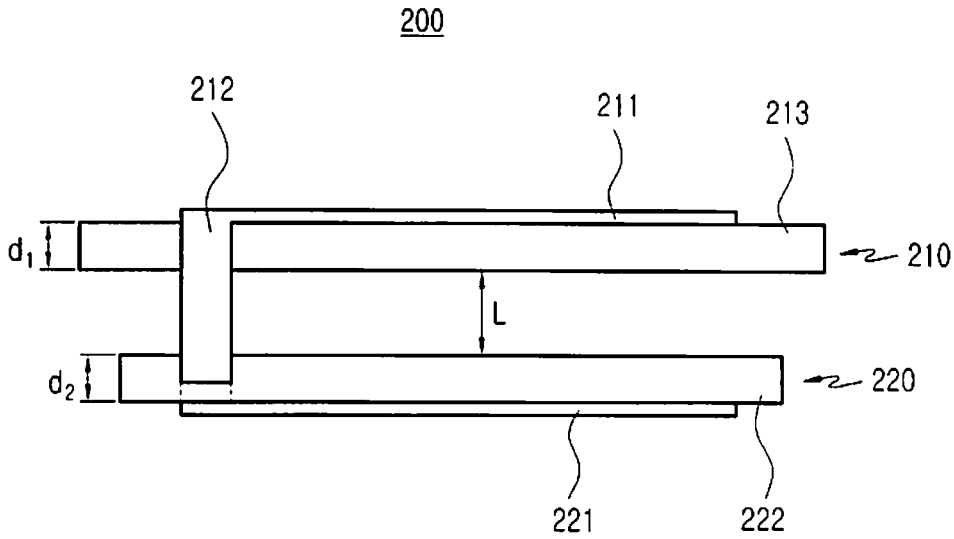
FIGS. 3A and 3B are cross-sectional diagrams of an internal antenna, according to a first embodiment of the present invention.
Figure 3B:
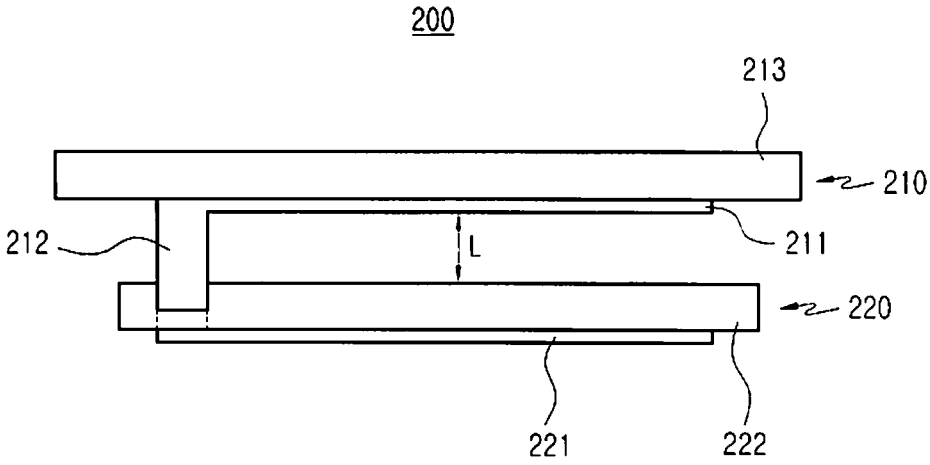

FIGS. 3A and 3B are cross-sectional diagrams of internal antennas according to an embodiment of the present invention. Each of the internal antennas 200 shown in FIGS. 3A and 3B includes first and second antennas 210 and 220, each having antenna patterns 211 and 221 formed on dielectric layers 213 and 222 having different dielectric constants.

The first antenna 210 includes the first dielectric layer 213 and the first antenna pattern 211 formed on the first dielectric layer 213. The second antenna 220 includes the second dielectric layer 222, which has a higher dielectric constant than the first dielectric layer 213, and the second antenna pattern 221 formed on the second dielectric layer 222. The first and second antennas 210 and 220 may be electromagnetically coupled and vertically arranged so as to be resonant.

A feed point 212 of the first antenna pattern 211 is extended to contact the second antenna pattern 221. The first antenna pattern 211 may be formed to branch to the second antenna pattern 221 based on the same feed point. The feed point 212 is a point at which an antenna pattern is started on a dielectric layer or a connecting portion to which an external electrical circuit is connected. The external electric circuit outputs an electrical signal (or an electrical current) to be converted into a radio wave to the first and second antennas 210 and 220 through the feed point 212, and the external electric circuit receives an electrical signal converted from a radio wave by the first and second antennas 210 and 220 through the feed point 212. Namely, the first and second antenna patterns 211 and 221 are formed to branch from the same feed point, and the first and second antenna patterns 211 and 221 are electrically connected to each other. The feed point 212 may be considered as an end portion of the first antenna pattern 211, and the first antenna pattern 211 may extend to the second antenna pattern 221. The feed point 212 may be considered as an electrically conductive portion disposed between flat base portions of the first and second antenna patterns 211 and 221.

Polycarbonate (its relative dielectric constant $\in_r=3$) may be used for the first dielectric layer 213. A material having a higher dielectric constant and a higher Q value than the first dielectric layer 213 may be used for the second dielectric layer 222. The first dielectric layer 213 may be formed of a dielectric material having a relative dielectric constant ranging from 0 to 10, and the second dielectric layer 222 may be formed of a dielectric material having a relative dielectric constant ranging from 4 to 100. Although the relative dielectric constant ranges for the first and second dielectric layers 213 and 222 overlap between 4 and 10, if the second dielectric layer 222 has a dielectric constant in the overlapped range, the first dielectric layer 213 may be formed of a material having a lower dielectric constant than the second dielectric layer 222.

FIG. 3A illustrates a structure in which the first antenna pattern 211 is formed on an upper surface of the first dielectric layer 213. FIG. 3B illustrates a structure in which the first antenna pattern 211 is formed on a lower surface of the first dielectric layer 213, which faces the upper surface of the second dielectric layer 222. The first and second antennas 210 and 220 constituting the internal antenna 200 are coupled to be resonant at a frequency band that the internal antenna 200 desires to receive. Each of the first and second antenna patterns 211 and 221 may be formed on the upper or lower surface of a corresponding dielectric layer 213, 222 or wound around the corresponding dielectric layer 213, 222. At least one of the first and second antenna patterns 211 and 221 may be buried in a corresponding dielectric layer 213, 222.

A frequency band (central frequency $f_1$) of the first antenna 210 and a frequency band (central frequency $f_2$) of the second antenna 220 are electromagnetically coupled ($f_1+f_2$) to be resonant. This means that a waveform of a desired reception frequency band of the internal antenna 200 is obtained as shown in a graph of a frequency band having a central frequency $f_3$ in FIG. 4.

To be electromagnetically resonant, the first and second antenna patterns 211 and 221 should correspond to each other. A separation interval L on three axes x, y and z between the first and second antennas 210 and 220 is not greater than 1 mm. A thickness $d_1$ of the first dielectric layer 213 is not greater than 2 mm and a thickness $d_2$ of the second dielectric layer 222 is not greater than 4 mm. The separation interval L is a distance between the lower surface of the first dielectric layer 213 and the upper surface of the second dielectric layer 222 in FIG. 3A, and the separation interval L is a distance between the flat base portion of the first antenna pattern 211 and the upper surface of the second dielectric layer 222 in FIG. 3B.

Figure 4:
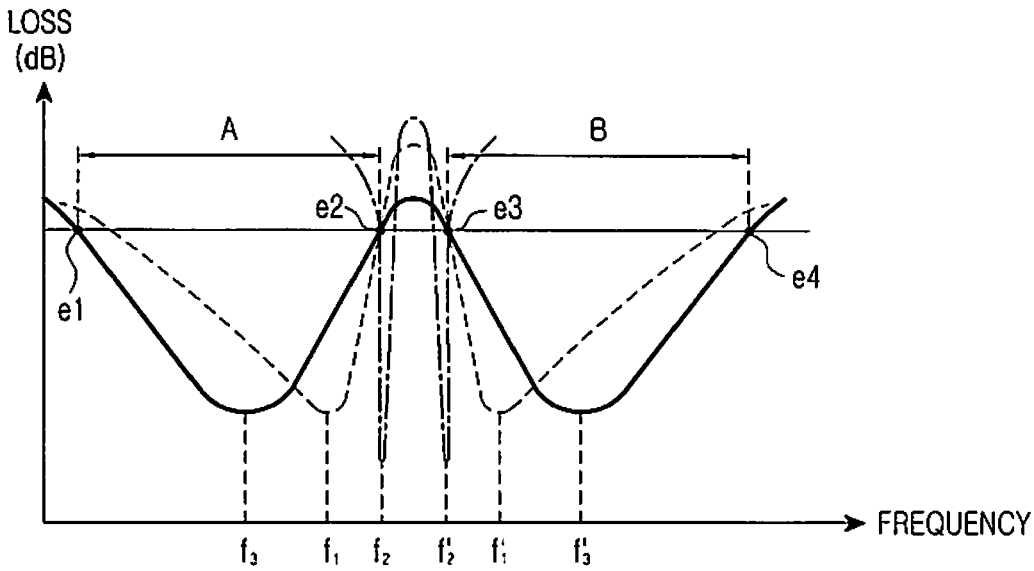
FIG. 4 is a graph showing an internal antenna, according to the first embodiment of the present invention.

FIG. 4 is a graph of antenna reception loss versus frequency showing an internal antenna, according to an embodiment of the present invention. Conventionally, an antenna reception loss is represented by an antenna return loss (S11). A solid line shown in FIG. 4 denotes a frequency band that the internal antenna according to the present invention desires to receive and central frequencies $f_3$ and $f_3'$ in that frequency band.

A dashed line shown in FIG. 4 denotes a graph illustrating central frequencies $f_1$ and $f_1'$ and a receivable frequency band of the first antenna. A dash-dotted line shown in FIG. 4 denotes a graph illustrating central frequencies $f_2$ and $f_2'$ and a receivable frequency band of the second antenna.

The internal antenna has central frequencies $f_3$ and $f_3'$ in receivable frequency bands A and B, and the receivable frequency bands A and B have four edges $e_1$, $e_2$, $e_3$, and $e_4$.

Because the receivable frequency band (solid line graph) of the internal antenna may be shifted due to hand phantom, a receivable frequency band of the first antenna is located at a shifted frequency band (central frequencies $f_1$ and $f_1''$) from the actually desired receivable frequency band.

The second antenna is formed on the dielectric layer having a higher dielectric constant than the first antenna. Therefore, the second antenna may have a higher Q value than the first antenna and the central frequencies $f_2$ and $f_2'$ of the higher Q value are located at edges of the receivable frequency band of the internal antenna.

Each of the central frequencies $f_2$ and $f_2'$ of the second antenna may be formed within ±30% of a frequency corresponding to one of edges $e_1$, $e_2$, $e_3$, and $e_4$ of the frequency band of the internal antenna. For example, if an edge frequency of the frequency band of the internal antenna is 820 MHz, the central frequency of the second antenna may be located between 570 MHz to 1.3 GHz. As another example, if the edge frequency is 1.8 GHz, the central frequency of the second antenna may be located between 1.26 to 2.7 GHz. More desirably, each of the central frequencies $f_2$ and $f_2'$ of the second antenna may be formed within ±20% of a frequency corresponding to one of edges $e_1$, $e_2$, $e_3$, and $e_4$ of the frequency band of the internal antenna.

The internal antenna according to embodiments of the present invention is configured such that the first and second antennas can be mutually resonant. Accordingly, signals can be transmitted and received at a frequency band that the internal antenna actually desires to receive. Further, since a central frequency of the second antenna having a high Q value is located within a preset range of the edge $e_1$, $e_2$, $e_3$, or $e_4$ of the internal antenna, a variation in a dielectric characteristic (dielectric constant) of a dielectric material due to contact with a user, and a shift of a frequency band can be minimized.

The internal antenna according to embodiments of the present invention can minimize a shift of a frequency band caused by hand phantom and deterioration of reception sensitivity, without increasing a size thereof. Specifically, the internal antenna according to embodiments of the present invention can minimize a required space because the length of the first antenna can be designed to be shorter than a length corresponding to a frequency band of the internal antenna.

Figure 5A:
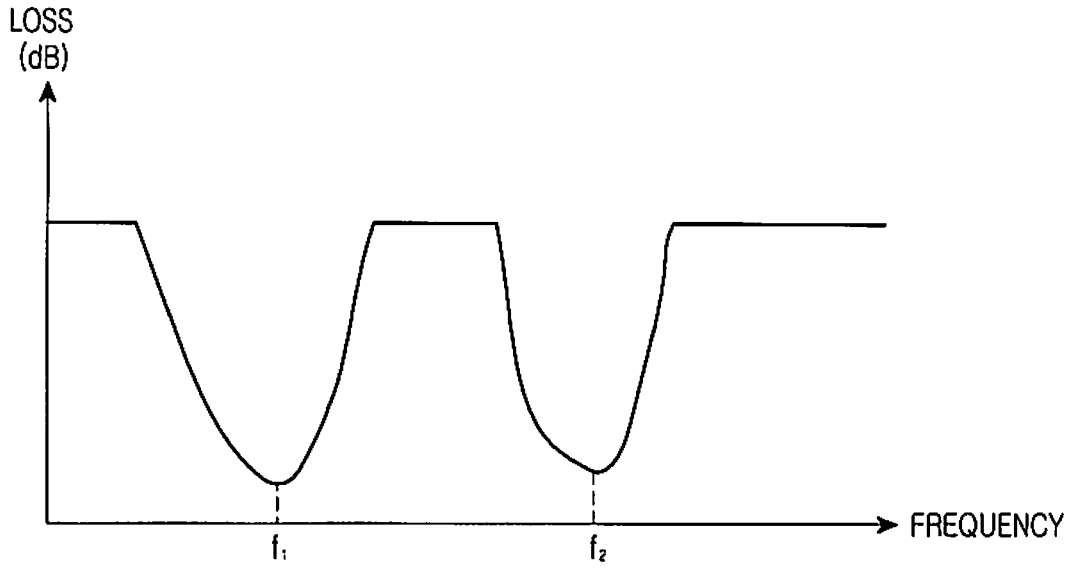
FIGS. 5A and 5B are graphs showing first and second antennas, according an embodiment of the present invention.
Figure 5B:
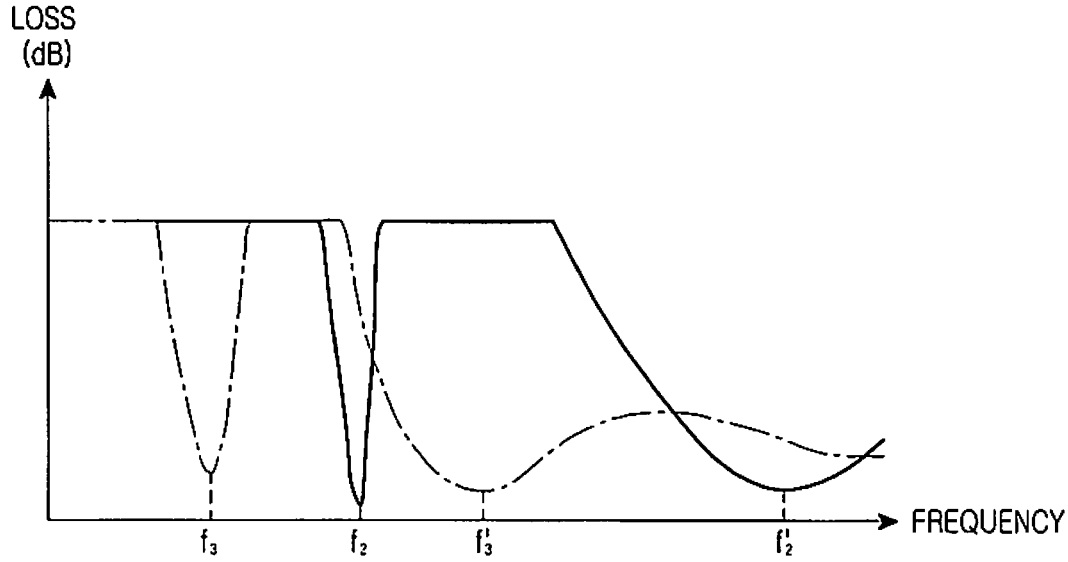

FIGS. 5A and 5B are graphs of antenna reception loss versus frequency showing first and second antennas, according to an embodiment of the present invention. FIG. 5A is a graph illustrating central frequencies $f_1$ and $f_1'$ and a frequency band of a first antenna. FIG. 5B is a graph illustrating central frequencies $f_2$ and $f_2'$ a frequency band (solid line) of a second antenna, and a frequency band (dashed line) after the second antenna is coupled with the first antenna.

Figure 6A:
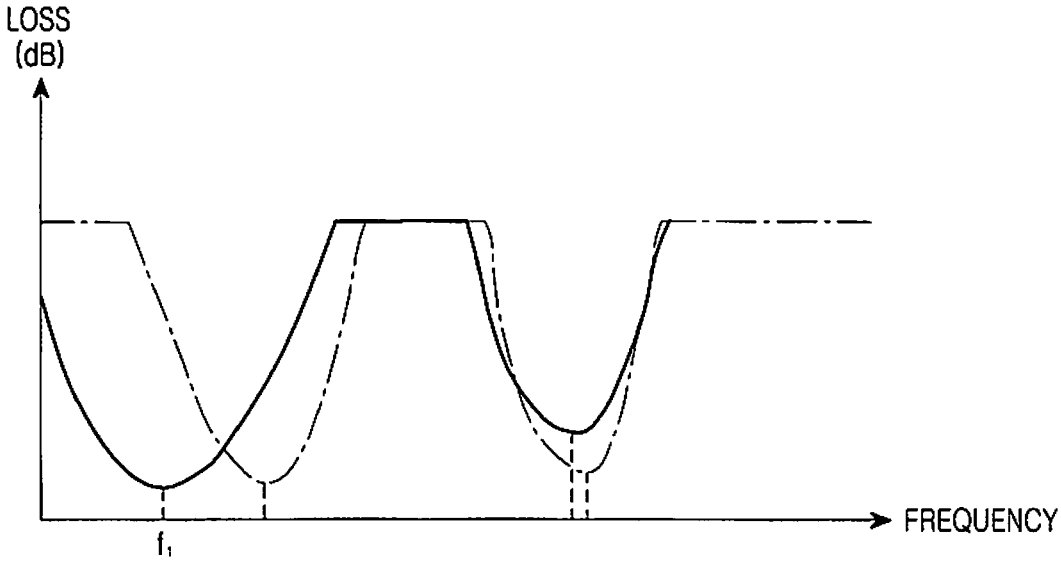
FIGS. 6A and 6B are graphs comparing variations in a frequency band due to hand phantom of a conventional internal antenna and an internal antenna according to an embodiment of the present invention.
Figure 6B:
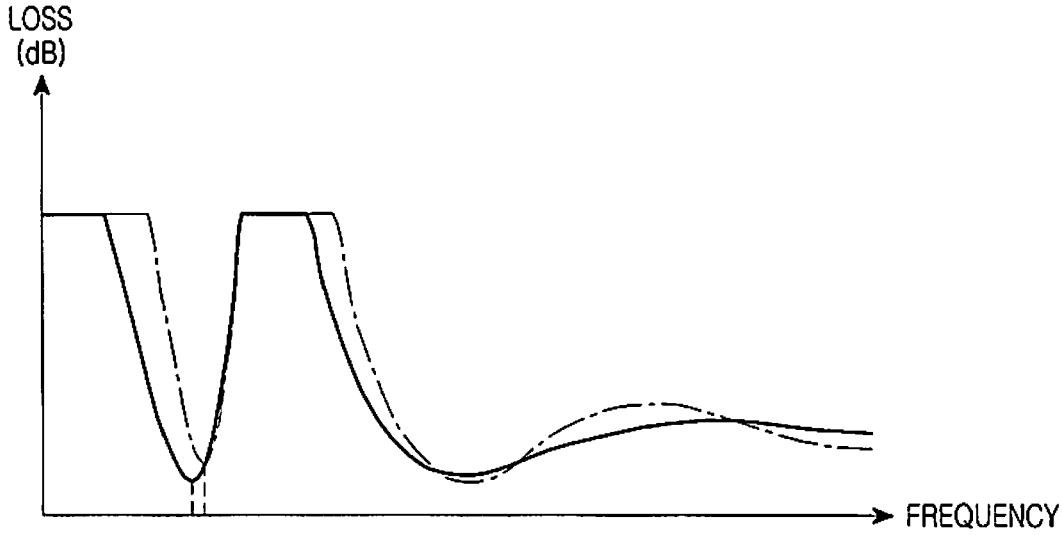

FIGS. 6A and 6B are graphs comparing variations caused by hand phantom in a frequency band of a conventional internal antenna and a frequency band of an internal antenna according to an embodiment of the present invention. In FIGS. 6A and 6B, dash-dotted lines illustrate desired reception frequency bands and solid lines illustrate shifted frequency bands due to hand phantom.

FIG. 6A shows a receivable frequency band (dash-dotted line) of a conventional antenna and a shifted frequency band (solid line) of the receivable frequency band due to hand phantom. FIG. 6B shows a frequency band when hand phantom occurs in the internal antenna, according to an embodiment of the present invention.

When comparing FIG. 6A with FIG. 6B, a variation width of a receivable frequency band due to hand phantom in FIG. 6B is less than that shown in FIG. 6A. Specifically, in FIG. 6B, a shifted frequency band due to hand phantom includes a frequency band that the internal antennal desires to receive and therefore deterioration of a reception rate caused by the shifted frequency band can be minimized.

Figure 7:
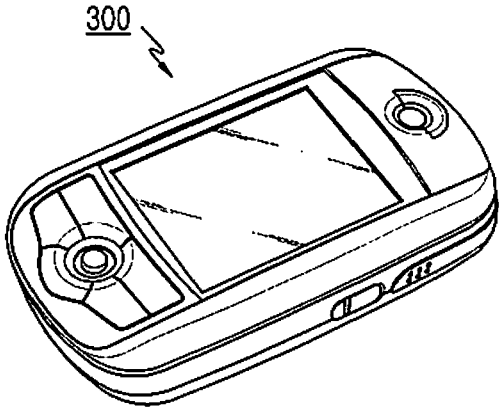
FIG. 7 is a diagram illustrating a portable communication terminal in which an internal antenna is mounted, according to a second embodiment of the present invention.

FIG. 7 is a diagram illustrating a portable communication terminal in which an internal antenna is mounted, according to a second embodiment of the present invention.

A portable communication terminal 300 according to the embodiment of the present invention includes an internal antenna of the same form as one of the internal antennas described in conjunction with FIG. 3A or 3B and a detailed description of the internal antenna conforms to the description of FIG. 3A or 3B.

Figure 8:
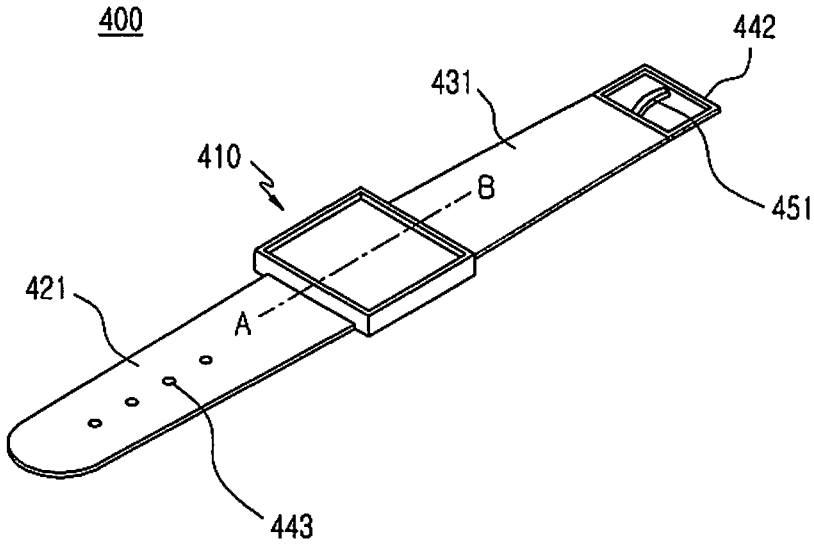
FIG. 8 is a diagram illustrating a portable communication terminal, according to a third embodiment of the present invention.

FIG. 8 is a diagram illustrating a portable communication terminal of a wrist watch type in which an internal antenna is mounted, according to a third embodiment of the present invention. A portable communication terminal 400 may include an internal antenna of the same form as that described in conjunction with FIG. 3A or 3B. A description of a repeated structure or construction may be considered to be the same as that of the internal antenna shown in FIG. 3A or 3B.

The portable communication terminal 400 of FIG. 8 has an internal antenna including a first antenna having a first antenna pattern formed on a first dielectric layer and a second antenna having a second antenna pattern formed on a second dielectric layer, which has a higher dielectric constant than the first dielectric layer. The first antenna pattern extends to the second antenna pattern. The internal antenna is mounted at the interior of a case (or housing).

In mounting the internal antenna, the portable communication terminal may include a housing or a case, formed of metal.

The portable communication terminal 400 is a type of a wristwatch that a user can wear. The portable communication terminal 400 includes a pin 451, a pin supporter 442, holes 443, and straps 421 and 431 extending from a body 410.

A portable communication terminal according to the present invention may include portable digital devices (e.g. Personal Digital Assistants (PDAs), PMPs, notebooks, and smart phones) having one or more of a DMB function, Internet, and a wireless communication function, and may include a navigation system for receiving Global Positioning System (GPS) signals. Specifically, the portable communication terminal may be applicable to small-size electronic devices requiring an antenna and portability.

Figure 9A:
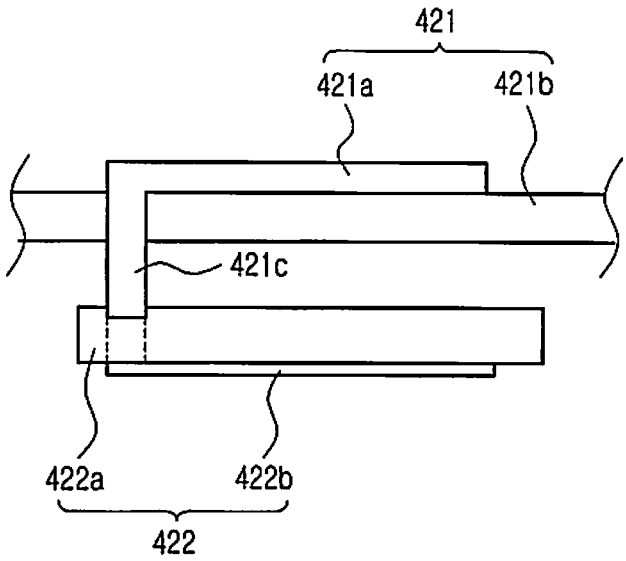
FIGS. 9A, 9B, and 9C are cross-sectional diagrams illustrating examples of mounting an internal antenna in the portable communication terminal shown in FIG. 8, according to embodiments of the present invention.
Figure 9B:
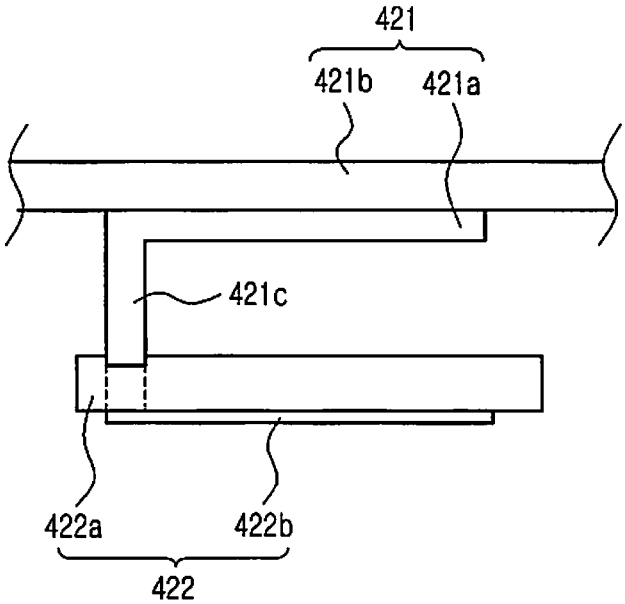
Figure 9C:
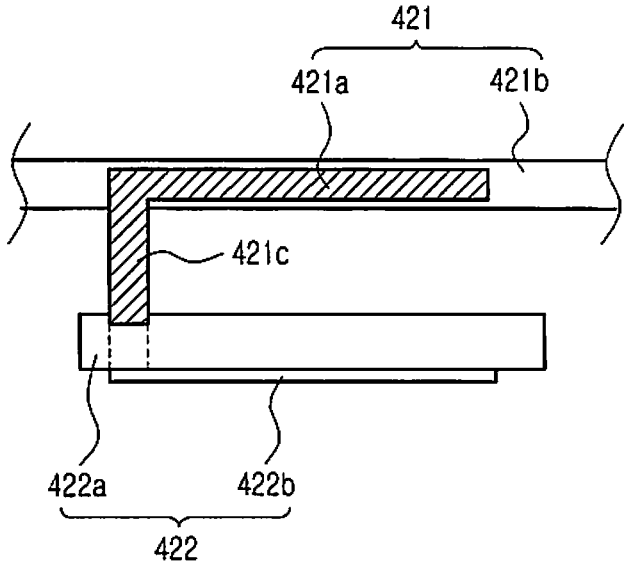

FIGS. 9A, 9B, and 9C are cross-sectional diagrams illustrating examples of mounting an internal antenna in a portable communication terminal, according to embodiments of the present invention. In FIGS. 9A, 9B, and 9C, a case of the portable communication terminal is formed of a dielectric material.

A portable communication terminal shown in FIG. 9A includes a first antenna 421 and a second antenna 422. The first antenna 421 includes a case 421*b* in which components of the portable communication terminal are mounted, and a first antenna pattern 421 a formed on an upper surface (outer surface) of the case 421*b*. The second antenna 422 has a second antenna pattern 422*b* formed on a dielectric layer 422*a*, which has a higher dielectric constant than the case 421*b*. A feed point 421*c* of the first antenna pattern 421*a* extends to the second antenna pattern 422*b*. Specifically, FIG. 9A shows an example of the portable communication terminal in which the first antenna pattern 421*a* is formed on the outer surface of the case 421*b*.

FIG. 9B is an example of a portable communication terminal in which the first antenna pattern 421*a* is formed on an inner surface of the case 421*b*. In FIG. 9C, the first antenna pattern 421*a* is a film type and is buried in the case 421*b* by in-mold injection molding. The second antenna pattern 422*b* may be a film type and buried in the case 421*b* instead of the first antenna pattern 421*a*.

The first antenna pattern 421*a* shown in FIGS. 9A to 9C may be a film type buried in the case, or may be attached to the outer or inner surface of the case 421*b*. The second antenna 422 may be formed on a printed circuit board. If the second antenna 422 is formed on a printed circuit board, the feed point 421*c* of the first antenna pattern 421*a* may extend to the printed circuit board.

According to embodiments of the present invention, the internal antenna includes a first antenna having a central frequency different from a central frequency of a desired reception frequency band and a second antenna formed on a dielectric layer having a higher dielectric constant than that of the first antenna. Deterioration of reception sensitivity due to a variation in a frequency band caused by physical contact with a user is minimized. In particular, a central frequency of the second antenna is located at an edge of a reception frequency band of the internal antenna, and thus, a variation in a reception frequency band caused by physical contact with a user can be minimized.

The internal antenna according to embodiments of the present invention maintains a small size, which makes it applicable to a limited space such as a portable communication terminal, and minimizes a variation in a radiant characteristic of an antenna due to hand phantom caused by physical contact with a user.

While the invention has been shown and described with reference to certain preferred embodiments thereof, it will be understood by those skilled in the art that various changes in form and detail may be made therein without departing from the spirit and scope of the invention as defined by the appended claims.

What is claimed is:

1. An internal antenna comprising:

a first antenna having a first antenna pattern formed on a first dielectric layer; and a second antenna having a second antenna pattern formed on a second dielectric layer, the second dielectric layer having a higher dielectric constant than the first dielectric layer;

wherein the first and second antenna patterns are electrically connected to each other, and wherein a central frequency of the first antenna and a central frequency of the second antenna are separated from each other.

2. The internal antenna of claim 1, wherein the second antenna has a higher Q value than the first antenna.

3. The internal antenna of claim 1, wherein the central frequency of the second antenna is located at an edge of a receivable frequency band of the internal antenna.

4. The internal antenna of claim 3, wherein the central frequency of the second antenna falls within ±20% of a frequency corresponding to the edge of the receivable frequency band of the internal antenna.

5. The internal antenna of claim 1, wherein a distance between the first antenna and the second antenna is less than or equal to 1 mm.

6. The internal antenna of claim 1, wherein the first and second antenna patterns branch from a same feed point.

7. The internal antenna of claim 1, wherein the first antenna and the second antenna are coupled to each other to be electromagnetically resonant.

8. The internal antenna of claim 1, wherein the first dielectric layer and the second dielectric layer are separated from each other by an air layer.

9. A portable communication terminal comprising:

a case; and an internal antenna comprising a first antenna having a first antenna pattern formed on a first dielectric layer, and a second antenna having a second antenna pattern formed on a second dielectric layer, wherein the second dielectric layer has a higher dielectric constant than the first dielectric layer, the first and second antenna patterns are electrically connected to each other, and the internal antenna is mounted in the case, and wherein a central frequency of the first antenna and a central frequency of the second antenna are separated from each other.

10. The portable communication terminal of claim 9, wherein the second antenna has a higher Q value than the first antenna.

11. The portable communication terminal of claim 9, wherein a distance between the first antenna and the second antenna is less than or equal to 1 mm.

12. The portable communication terminal of claim 9, wherein the first dielectric layer and the second dielectric layer are separated from each other by an air layer.

* * * * *